United States Patent [19]

DeRocco

[11] 4,300,431

[45] Nov. 17, 1981

[54] PITCH EXTRACTOR CIRCUIT

[76] Inventor: Paul DeRocco, 74 Union St., Bridgewater, Mass. 02324

[21] Appl. No.: 103,638

[22] Filed: Dec. 14, 1979

Related U.S. Application Data

[63] Continuation of Ser. No. 914,706, Jun. 12, 1978, abandoned.

[51] Int. Cl.[3] ..... G10H 1/06; G10H 3/18

[52] U.S. Cl. ..... 84/1.01; 84/1.11; 84/1.16

[58] Field of Search ..... 84/1.01, 1.11, 1.12, 84/1.16, 1.19, 1.21, 1.24, 1.28

[56] References Cited

U.S. PATENT DOCUMENTS

| | | | |
|---|---|---|---|
| 3,476,863 | 11/1969 | Campbell | 84/1.01 |
| 3,539,701 | 11/1970 | Milde | 84/1.28 |
| 3,591,699 | 7/1971 | Cutler | 84/1.11 |
| 3,634,596 | 1/1972 | Rupert | 84/1.28 |
| 3,647,929 | 3/1972 | Milde, Jr. | 84/1.01 |
| 3,871,247 | 3/1975 | Bonham | 84/1.16 |
| 3,902,395 | 9/1975 | Avant | 84/1.16 |
| 4,151,775 | 5/1979 | Merriman | 84/1.01 |

*Primary Examiner*—Stanley J. Witkowski
*Attorney, Agent, or Firm*—Cesari and McKenna

[57] ABSTRACT

A pitch extractor for an electronic musical instrument generates a digital count indicative of the period of the signal whose frequency is to be extracted and processes this count to provide an analog control voltage corresponding to this frequency; the control voltage is usable to control an electronic music synthesizer. The rate at which the pitch is extracted is enhanced by initially setting the system for the expected pitch of the musical source and thereafter adjusting it to the actual pitch of the source in a closed-loop manner as extraction proceeds.

1 Claim, 4 Drawing Figures

PITCH EXTRACTOR CIRCUIT

This is a continuation of application Ser. No. 914,706, filed June 12, 1978, and now abandoned.

BACKGROUND OF THE INVENTION

A. Field of the Invention

The invention relates to electronic musical instruments and, more particularly, comprises an extractor for an electronic musical instrument.

B. Prior Art

Electronic music synthesizers create varied musical sounds by generating and processing various basic waveforms to provide the desired sound. This commonly takes place under control of a player who "shapes" the waveforms by changing their amplitude, spectral content, envelope, etc. by means of various controls associated with the synthesizer.

The most basic control used in synthesizers is that which establishes the "note" to be played. Typically, this is accomplished by means of a keyboard which the user plays in the same manner as a conventional organ or piano instrument. Generally, each key on the keyboard is tuned to provide a specific frequency or "pitch" of one or more octave ranges. These instruments are highly desirable and useful, but not appropriate for users whose playing skills are directed to musical instruments which do not use a keyboard.

BRIEF SUMMARY OF THE INVENTION

A. Objects of the Invention

Accordingly, it is an object of the invention to provide a pitch extractor for electronic musical instruments.

Further, it is an object of the invention to provide a pitch extractor which rapidly and accurately derives the fundamental frequency an electronic signal applied thereto.

Yet another object of the invention is to provide a pitch extractor for a stringed musical instrument.

B. Brief Description of the Invention

The pitch extractor of the present invention is particularly adapted to extraction of the pitch of a stringed instrument, such as a guitar, whose pitch may be continuously varied by a player during his playing, and thus the invention here will be described with particular reference to such an instrument. The extractor provides, as a final output, a control voltage indicative of the pitch of the note being played and usable to control an electronic music synthesizer which can generate and produce a variety of electrical signals representative of various "sounds" to be produced. The pitch extractor of the present invention, when so coupled with a synthesizer, thereby allows the player of a stringed instrument to produce musical sounds not usually obtainable with the stringed instrument itself.

More particularly, the pitch extractor described here comprises a number of signal processing channels for converting an electric input signal corresponding to the playing of a note on a stringed instrument, such as a guitar, into the desired synthesizer control voltage. A first channel of the extractor identifies the string that is being played and initially sets the pitch extractor to process the note from this string efficiently. A second channel generates a control voltage corresponding to the actual note being played on that string and modifies the extractor setting in accordance with that control voltage. A third channel generates timing signals to further control the extraction process.

The first channel of the extractor includes a number of trigger detector circuits, one for each string. For a typical guitar, there are six detectors, corresponding to the E, A, D, G, B and E strings, respectively. Each of these generates a brief pulse whenever its corresponding string is played. The trigger generators are connected to a priority encoder circuit whose output is a three bit digital code uniquely identifying which of the six strings has been played. This "string code" is applied to an initial pitch controller to set the extractor initially to process a frequency corresponding to the fundamental frequency of the string being played. It is also applied to an audio multiplexer located in the first signal channel to gate the actual signal (the "source signal") generated by the playing of that string into the first channel for processing.

In this channel the source signal is applied to a voltage controlled filter and thence to a peak compressor, followed by a pair of peak detector circuits. The voltage controlled filter is a low-pass filter whose passband is controlled by the extractor control voltage. As noted previously, the extractor control voltage is initially established to correspond to the fundamental frequency of the string being played. The peak detectors measure the positive and negative peaks of the filtered source signal and provide outputs to a level detector circuit whenever the source signal passes through certain preestablished levels. A gate circuit responsive to the level detector tracks the level transitions of the source signal and provides an output pulse train whose frequency is proportional to the frequency of the source signal.

A counter circuit driven by a fixed clock is controlled from the pulse train that had been derived from the signal source. The counter circuit is periodically reset by the pulse train so that, immediately prior to reset, its output contains a count that is proportional to the period of the pulse train. This count is transferred to a set of latches immediately prior to the time that it is cleared from the counter and thence into a multiple stage shift register which shifts the count through it, one position at a time. An output counter connected to the shift register provides an output pulse train at a rate proportional to the frequency of the source signal. This pulse train is applied to a phase-locked loop comprising a phase comparator and a voltage-controlled oscillator driven by the comparator to a frequency equal to that of the output pulse train. The error voltage driving the oscillator is a measure of the frequency of the source signal and this error voltage is thus utilized as a control voltage for the synthesizer. The control voltage is also applied to the voltage controlled filter in the first channel to adjust the cut-off frequency of this filter to correspond to the actual frequency of the source signal. Thus, the "correct" frequency of the source signal, and accordingly the "correct" control voltage, is quickly established.

The third signal processing channel provides the various logical control signals utilized in the extraction process. It includes a rectifier-filter circuit for providing a unipolar envelope of the source signal, and a gate generator providing a gating level signal as long as the amplitude of the envelope is above a predetermined level.

DETAILED DESCRIPTION OF THE INVENTION

The foregoing and other and further objects and features of the invention will be more readily understood when reference to the following detailed description of the invention, when taken in conjunction with the accompanying drawings in which.

Figure 1:
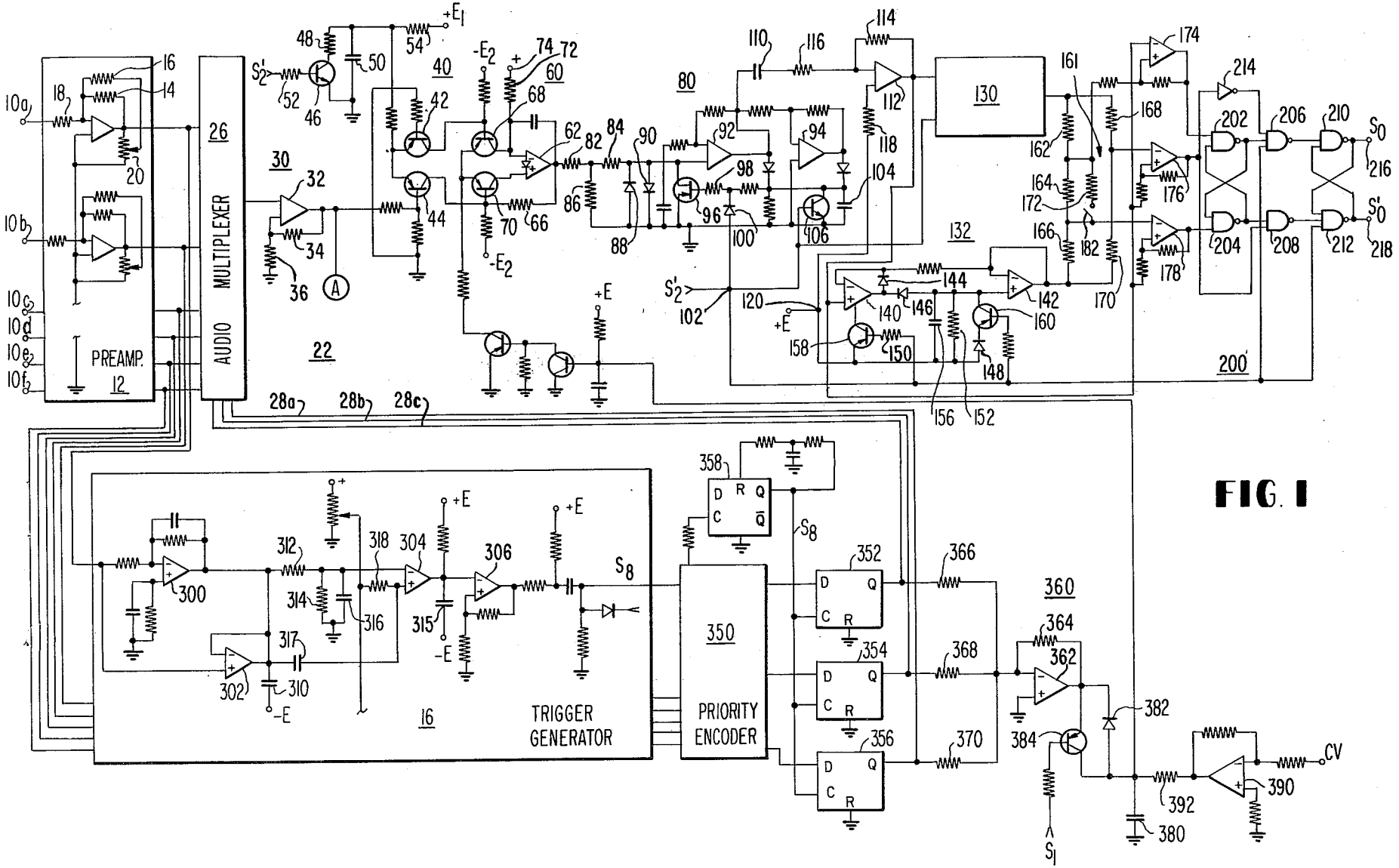
FIG. 1 is a block and line diagram of first and second signal processing channels in accordance with the present invention.

In FIG. 1, electric signals corresponding to the playing of any of the strings of a musical instrument, such as the strings of a guitar, are applied to input terminals 10*a*–10*f* and individually amplified by preamplifiers 12, there being one such preamplifier for each string. Each preamplifier consists of an operational (high input impedance, low output impedance, high gain) amplifier 14 having gain-setting resistors 18 and gain-adjustment potentiometer 20 connected thereto; the non-inverting input terminals of each amplifier are connected to ground. The outputs of the preamplifiers are connected to a first signal channel 22 and a second signal channel 24 for further processing.

Signal channel 22 includes an audio multiplexer 26 that is gated by selection signals on lines 28*a*–28*c* to pass a selected one of the six signals applied to the multiplexer to a further amplifier circuit 30; the latter comprises an operational amplifier 32 and gain setting resistors 34, 36. The multiplexer 26 may advantageously comprises a CD 4051 audio multiplexer, with two of its input terminals being unused in the application shown. The output of amplifier 30 is applied to a voltage-controlled amplifier 40 from a pair of bipolar transistors 42, 44, having their emitters connected in common in a differential-amplifier configuration. The amplifier is gated on and off by means of a transistor 46 connected in series with a resistor 48 across a capacitor 50. A control signal applied to the base of the transistor 46 via a resistor 52 shunts the amplifier power supply, connected to terminal 54, to ground when the transistor is turned "on", that is, when a positive signal is applied to the base of this transistor. Capacitor 50 limits the rate of the transition between the on and off states.

The output of amplifier 40 is applied to a voltage-controlled filter 60 shown illustratively as comprising a transconductance amplifier 62, a filter capacitor 64, a feedback resistor 66, and bipolar input transistors 68, 70. A source of bias current is applied to the amplifier 62 through a resistor 72 and a source of potential connected to terminal 74. The cut-off frequency of filter 60 is controlled by a control voltage applied to the base of transistors 68, 70 as will be described in detail subsequently. Filter 60 is illustratively illustrated as a single pole filter; it will be understood, however, that multiple-pole filters may be desirable and even advantageous, and can be obtained simply by cascading additional stages of the type shown in filter stage 60.

The level of the source signal applied to the input terminals 10*a*–*f* may vary over a wide dynamic range, depending on the particular piece being played and the characteristics of the individual player. Accordingly, the output of the voltage controlled filter 60 is applied to a peak compressor 80 comprising input resistors 82, 84, 86; limiting diodes 88, 90; and operational amplifiers 92, 94. Field effect transistor 96, in conjunction with resistor 98 and diode 100, establishes the gain of amplifier 92 in response to signals applied to a control terminal 102. Similarly, capacitor 104, establishes the gain of amplifier 94. Transistor 106 shunts out capacitor 104 when a positive signal is applied to terminal 102.

The output of peak compressor 80 is applied through a coupling capacitor 110 and amplified in a circuit comprising operational amplifier 112 and resistors 114 and 116. The amplifier 112 is referenced through a resistor 118 to a positive voltage level at terminal 120; this level is halfway between the maximum and minimum peak levels which, illustratively, are at 15 and 0 volts, respectively. Peak detectors 130 and 132 are also referenced to the voltage level applied to the terminal 120 and receive the output of the amplifier 112.

Peak detector 132 is formed from amplifiers 140, 142; diodes 144, 146, 148; resistors 150, 152, 154; capacitor 156; and bipolar transistors 158, 160, and detects the negative-going peak of the source signal. Detector 130 is constructed similarly to detector 132, but with the polarities of the diodes and transistors reversed; it detects the positive going peaks of the signal source. Peak detector 132 is gated on and off by signals applied to control terminal 102, as is peak detector 130.

The outputs of peak detectors 130 and 132 are combined in level detection network 161 comprising resistors 162–172. Amplifiers 174, 176, 178 are connected as comparators. Each of these amplifiers receives the output of the peak compressor via a lead 180; they also receive voltage levels of different magnitudes from the peak detectors 130, 132 via the resistor network 162–172. Comparator 174 provides an output when the source signal exceeds an upper-level threshold voltage; comparator 176 provides an output whenever the signal source exceeds a mid-level threshold voltage; and comparator 178 provides an output whenever the source signal exceeds a lower-level threshold voltage. The voltages applied to the respective comparators may be changed during the extraction process by means of a switch 182 which switches resistor 172 into and out of the resistor network. Thus, during initial extraction of the frequency of the source signal, it is advantageous to set the voltage levels applied to the comparator to trigger the appropriate comparators when the source signal passes above 75% of its amplitude or below 25% of its amplitude. Once the initial extraction interval has passed, resistor 172 may be switched into the network by closing switch 182 in order to set the comparator levels at 90% of the initial source amplifier level and 10% of this level, respectively.

Figure 4:
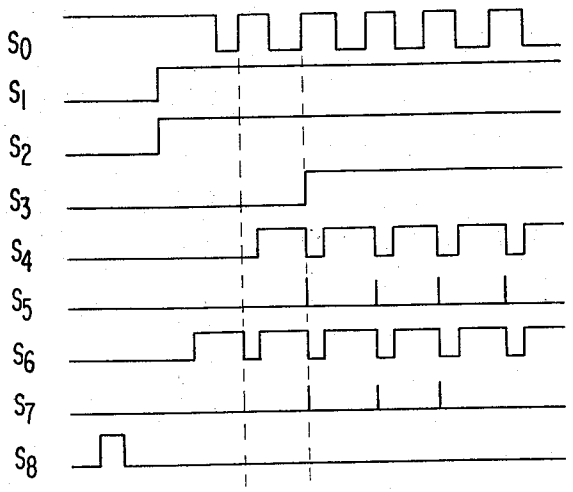
FIG. 4 shows the control signals used in the present invention.

The comparators 174–178 drive a logic network 200 consisting of inverting NAND gates 202–212 and inverter 214. Network 200 insures that the source signal passes through at least one full cycle before timing signals are derived from it. The output $S_0$ of the network appears at terminal 216 and comprises a pulse train at the frequency of the source signal (see FIG. 4); its complement pulse train appears at the terminal 218.

Figure 3:
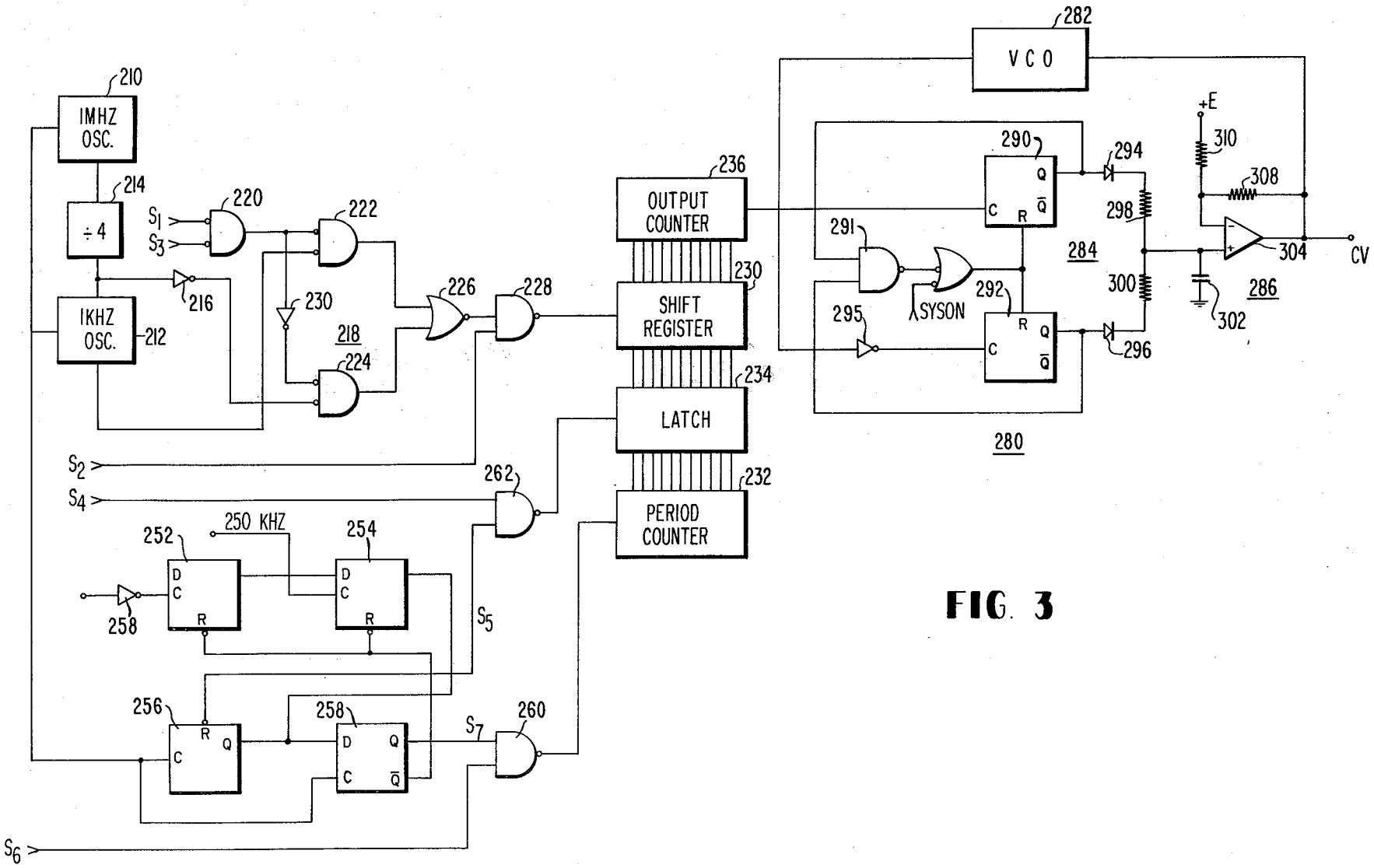
FIG. 3 is a block and line diagram of a third signal processing channel forming pitch of the extractor of the present invention.

Turning now to FIG. 3, the manner of generating the desired control voltage from the clock signal drive in FIG. 1 is shown. High frequency oscillator 210 and low frequency oscillator 212 provide square wave pulse trains for driving the counters and shift registers used in implementing the present invention. Oscillator 210 preferably provides an output at a 1 megahertz rate, while oscillator 212 desirably provides an output at a 1 kilohertz rate. A two stage binary divider 214 connected to oscillator 210 provides a further square wave output at a frequency of 250 kilohertz and applies this through an inverter 216 to a gating circuit 218 comprising NOR gates 220, 222, 224, and 226, NAND gate 228 and inverter 230. Gate 220 is gated by means of control signals $S_1$ and $S_3$ which are obtained as shown in FIG. 3 and described later, while gate 228 is gated by control signal $S_2$. The logic circuit 218 drives a shift register 230 at either a 250 kilohertz rate or a 1 kilohertz rate, dependent on the status of control signals $S_1$–$S_3$. An input counter 232 is driven with a 250 kilohertz signal from the output of divider 214. It is connected to shift register 230 by latches 234. The output of shift register 230 is applied to output counter 236 which is driven at a 1 megahertz rate by oscillator 210.

Register control circuit 250 controls the progress of the count in counter 232 and its subsequent transfer. Circuit 250 comprises complementing flip flops 252–256, illustratively type 74LS74 flip flops. Flip flop 252 is driven from $S_0'$ via inverter 258; its output is clocked into flip flop 254 by the 250 kilohertz clock signal. The output of flip flop 254 is applied to the reset terminal of flip flop 256, which in turn is clocked from the 1 megahertz clock 210. The clock 210 also drives the flip flop 258 which is connected to receive an input from the output of flip flop 256.

Flip flop 258 generates a counter clear signal $S_7$, to periodically clear the counter 232. This signal is gated with a clear enable signal $S_6$ in a gate 260. Similarly, flip flop 256 generates a transfer signal $S_5$ to transfer the contents of the counter 232 to a shift register 230 through the latches 234. It is gated with a transfer enable signal $S_4$ through a gate 262.

Counter 232 continuously counts in response to the clock driving signal from the divider 214. It is reset each time a source frequency signal $S_0$ is passed through the circuit 250. Immediately prior to being reset, its count is transferred through the latches 234 to the shift register 230. The latter advantageously comprises a type 2519 multiple-stage shift register which is connected to shift the count transferred through itself, one digit at a time. The shift register is 12 bits wide and 40 bits long. It passes bits through itself as long as $S_2$ is present. Initially (i.e., for the first 50 milliseconds after a note is played) it is clocked at a 250 kilohertz rate so that the number representing the note period is quickly passed through it. The note pitch is thereby quickly extracted. After this initial period, the shift register is clocked at a 1 kilohertz rate so that the number representing the note period is delayed 40 milliseconds before it is passed to the counter 236. This insures that spurious pitch information that normally occurs at the end of a guitar note, will be masked and thus wil not cause a pitch droop (shift in pitch). The contents of the shift register are then applied to counter 236 which provides a pulse train output at a rate inversely proportional to the contents of counter 232.

The pulse train from counter 236 is converted to a voltage in a pitch to voltage converter 280 comprising a voltage controlled oscillator 282, a phase comparator 284, and an averaging circuit 286. Phase comparator 284 is formed from flip flops 290, 292, NAND gates 291, 293 and inverter 295. Flip flop 290 is driven from the counter 236, while flip flop 292 is driven from voltage controlled oscillator 282.

The outputs of flip flop 290 and 292 are applied through diodes 294, 296 and resistors 298, 300 to a smoothing capacitor 302 which is buffered by means of an amplifier 304 having gain-setting resistors 308, 310 associated with it. The output of amplifier 304 in turn is applied to the oscillator 282 to change its frequency in one direction or another depending on the voltage on the capacitor 302. Phase comparator 284, filter 286, and voltage controlled oscillator 282 form a phase-locked loop. Its action as such is to drive the oscillator 282 to a frequency proportional to that of the counter 236. The error voltage at the output of amplifier 304 that is applied to the oscillator 282 to drive it to this frequency is directly related to the frequency of the source signal as measured by the counter 236, and thus provides the desired control voltage indicative of the source signal frequency. This control voltage may be applied to an electronic music synthesizer to control its output in a known manner. It is also applied to one of the signal channels in FIG. 1, as will be described in more detail below.

Figure 2:
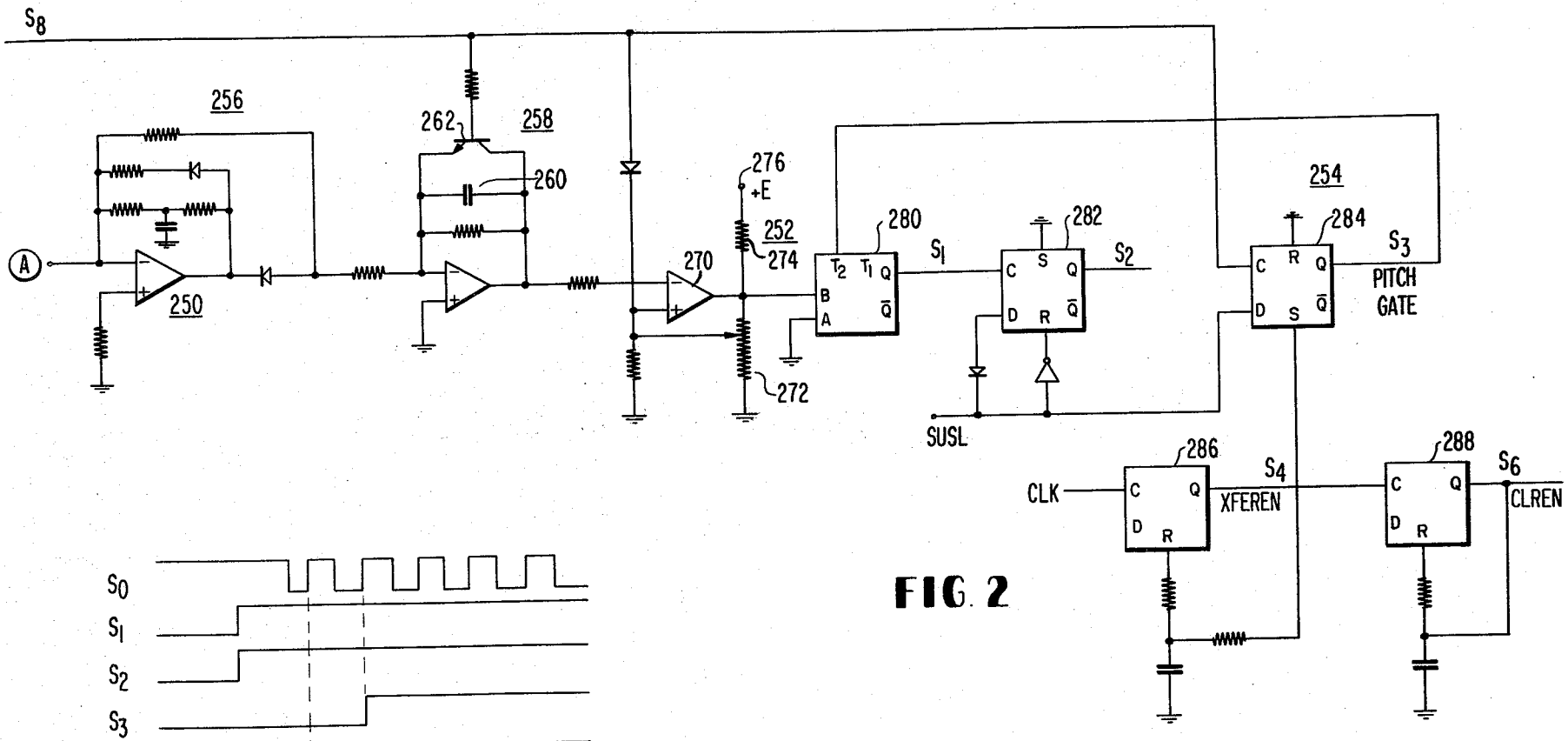
FIG. 2 is a block and line diagram of a further portion of the signal processing channels of FIG. 1.

Turning now to FIG. 2, the amplifier source signal from the audio multiplexer 26, after amplification in amplifier 30, is also applied to a third signal channel comprising rectifier-filter 250, gate generator 252 and gating circuit 254. The rectifier-filter 250 provides a rectified version of the source signal in a rectifier circuit 256 and provides the envelope of this signal by means of a low-pass filter 258. The smoothing capacitor 260 associated with this filter is periodically discharged on receipt of a control signal $S_8$ from the trigger generator 16 of FIG. 1 whenever a new note is played.

Gate generator 252 includes an amplifier 270 whose non-inverting input is referenced to an adjustable voltage level by means of a potentiometer 272, a resistor 274; and a voltage applied to a terminal 276. When the output of the envelope from the filter 258 exceeds the level established by the potentiometer 272, the output of the amplifier 270 suddenly changes its state and generates a pulse which is applied to the gating circuit 254.

The gating circuit 254 includes a monostable multivibrator 280, and flip flops 282–288. Miltivibrator 280 is triggered by the output of the gate generator 252 and its output sets flip flop 282. The output of this flip flop in turn drives flip flop 284. The output of the latter is connected back to the multivibrator 280 to reset it to its inactive state after a predetermined time delay.

Multivibrator 280 and flip flops 282 and 284 generate control signals here designated as $S_1$, $S_2$ and $S_3$, respectively. These signals control the circuitry shown in FIGS. 1 and 2 and indicate that extraction of the frequency of the source signal is in progress. Flip flops 286 and 288 generate gating signals for transfer of the contents of the counters and shift registers in FIG. 2. Thus, flip flop 286 receives a clock input from the output $S_0$ of logic circuit 200 (FIG. 1) and generates a transfer enable pulse, $S_4$. Flip flop 288 is clocked by the transfer enable pulse and generates a clear enable signal, $S_6$. These signals are utilized as shown in FIG. 2.

Returning to channel 24 of FIG. 1, trigger generator 16 is formed from operational amplifiers 300, 302, 304, 306 and associated resistors and capacitors. There is one such trigger generator for each of the strings which is to be played; however, for ease of illustration, only a single such generator is shown, it being understood that the remaining generators are similarly constructed. After passage through one of the preamplifiers 12, the source signal applied to one of the input terminals 10*a*–10*f* is applied to the inverting input of amplifier 300, and the non-inverting input of amplifier 302. Amplifiers 300 and 302 form a peak follower; their outputs are connected together and applied to a capacitor 310. The voltage stored in this capacitor is applied to a low-pass filter comprising resistors 312 and 314 and capacitor 16; simultaneously, it is applied to a high-pass filter comprising capacitor 316 and resistor 318. The output of the low-pass filter is applied to the non-inverting input of amplifier 304, while the output of the high-pass filter is applied to the inverting input of this amplifier. Capacitor 315 at the output of this amplifier is normally charged from positive and negative sources, respectively, applied to terminals 316, 318, respectively. However, when the voltage applied to the inverting input of amplifier 304 exceeds that applied to the non-inverting input, amplifier 304 discharges capacitor 314. The discharge of this capacitor is converted to a rectangular pulse by the amplifier 306. This pulse is the trigger pulse, $S_8$, designating the playing of a new note.

The pulses from the trigger generator 16 are applied to priority encoder 350 which provides an output indicative of the last pulse. The encoder 350 may advantageously comprise a CD4532 8-to-3 encoder with two of its inputs unused. The output of encoder 350 is applied to flip flops 352, 354, 356 and are clocked into the flip flops by means of a further flip flop 358 which provides a brief trigger pulse $S_8$, whenever an input is applied to encoder 350. These outputs comprise a three digital code identifying the string which is being played. This code is applied to the audio multiplexer 26 as previously described and is also applied to digital to analog converter 360 comprising amplifier 362 and resistors 364–370.

A storage capacitor 380 receives the output of amplifier 362 via a diode 382 and a bipolar transistor 384. Transistor 384 is driven by a control signal $S_1$ generated by the monostable multivibrator 280 of FIG. 3. When this signal is high, it turns the transistor 384 on and thus couples the output of the amplifier 362 to capacitor 380.

Capacitor 380 also receives the control voltage generated by the pitch-to-voltage converter 280. This control voltage is applied to amplifier 390 and thence to capacitor 380 through resistor 392. During the initial pitch extraction interval, that is, prior to the time that the output of multivibrator 280 is turned off by the output of flip flop 284 (see FIG. 2), the output of amplifier 362 is coupled directly to capacitor 380 via transistor 384. The voltage on capacitor 380 is thus determined by the voltage at the output of amplifier 362, independent of the magnitude of the control voltage applied to amplifier 390. This sets the cut-off frequency of filter 60 in signal channel 22 to correspond to that of the fundamental frequency of the selected string. However, after the control signal $S_1$ ceases, transistor 384 turns off and amplifier 362 is effectively decoupled from capacitor 380. This capacitor then charges to a level determined by the control voltage applied to amplifier 390 and the cut off frequency of the filter 60 is then set to correspond to the actual frequency of the string being played. This greatly facilitates the extraction process by speeding the correct pitch acquisition process and minimizing the pitch sliding which might otherwise be obtained in reaching the desired frequency.

From the foregoing, it will be seen that I have provided an improved pitch extractor. The extractor efficiently generates a control voltage corresponding to the frequency of the particular string being played. It initially sets the frequency at a level corresponding to that of the fundamental of the string being played so that subsequent transitions of the extraction circuitry to the correct frequency are minimized.

Having illustrated and described my invention, I claim:

1. A pitch extractor for an electronic musical instrument, comprising:

A. an envelope generator connected to receive a waveform whose pitch is to be detected and providing a signal corresponding to the envelope thereof;

B. a gate generator providing a gate output whenever said envelope generator signal rises above a predetermined level;

C. peak detection means providing outputs indicative of the successive passage of said signal through predetermined levels;

D. gating means responsive to the output of said peak detection means to provide a pulse train indicative of the rate at which said signal passes through successive levels;

E. a counter operative in response to output from said gate generator connected to receive said pulse train for providing a count indicative of the period of said pulse train; and F. means providing an analog control voltage corresponding to said count for controlling said electronic musical instrument therefrom.

* * * * *